US008876022B2

(12) United States Patent
Kim et al.

(10) Patent No.: US 8,876,022 B2
(45) Date of Patent: Nov. 4, 2014

(54) DROPLET DISCHARGE HEAD AND DROPLET DISCHARGE APPARATUS

(75) Inventors: In-Tae Kim, Pohang (KR); Geunbae Lim, Pohang (KR); Seong-Wan Kim, Pohang (KR)

(73) Assignee: Postech Academy—Industry Foundation, Pohang (KR)

( * ) Notice: Subject to any disclaimer, the term of this patent is extended or adjusted under 35 U.S.C. 154(b) by 810 days.

(21) Appl. No.: 12/361,633

(22) Filed: Jan. 29, 2009

(65) Prior Publication Data

US 2009/0256002 A1 Oct. 15, 2009

Related U.S. Application Data

(60) Provisional application No. 61/044,072, filed on Apr. 11, 2008.

(51) Int. Cl.

| | |
|---|---|
| ***B05B 7/06*** | (2006.01) |
| ***B05B 7/08*** | (2006.01) |
| *B05B 1/02* | (2006.01) |

(52) U.S. Cl.

CPC ..... *B05B 7/0884* (2013.01); *B05B 7/066* (2013.01); *B05B 7/0861* (2013.01); *B05B 1/02* (2013.01)

USPC ..... 239/424.5; 239/71; 239/290; 239/296; 239/332; 239/423; 239/424; 239/566; 222/420; 73/864.81

(58) Field of Classification Search

USPC ..... 239/104–123, 418, 424, 71, 74, 290, 239/302, 332, 346, 423, 424.5, 296, 549, 239/558, 566, 128, 138; 73/864.81; 222/420

See application file for complete search history.

(56) References Cited

U.S. PATENT DOCUMENTS

| | | | | |
|---|---|---|---|---|
| 3,554,450 | A * | 1/1971 | D'Muhala | 239/309 |
| 4,717,049 | A * | 1/1988 | Green et al. | 222/420 |
| 5,186,363 | A * | 2/1993 | Haynes | 222/145.5 |
| 5,289,975 | A * | 3/1994 | Miller et al. | 239/79 |
| 5,431,343 | A * | 7/1995 | Kubiak et al. | 239/105 |
| 5,862,986 | A * | 1/1999 | Bolyard et al. | 239/290 |
| 6,119,953 | A * | 9/2000 | Ganan-Calvo et al. | 239/8 |
| 6,386,463 | B1 * | 5/2002 | Ganan-Calvo | 73/864.81 |
| 6,488,773 | B1 * | 12/2002 | Ehrhardt et al. | 239/135 |
| 6,602,554 | B1 * | 8/2003 | Kwok | 427/427.3 |
| 6,712,906 | B2 * | 3/2004 | Estelle et al. | 118/683 |
| 2008/0268147 | A1 * | 10/2008 | Burger et al. | 427/207.1 |

* cited by examiner

*Primary Examiner* — Steven J Ganey

(74) *Attorney, Agent, or Firm* — Lexyoume IP Meister, PLLC

(57) ABSTRACT

The present invention relates to a droplet discharge apparatus that includes a nozzle for discharging a droplet from a tip thereof, and a discharge unit for injecting a gas toward the tip of the nozzle.

12 Claims, 4 Drawing Sheets

DROPLET DISCHARGE HEAD AND DROPLET DISCHARGE APPARATUS

CROSS-REFERENCE TO RELATED APPLICATION

This application claims priority to and the benefit of U.S. Patent Application No. 61/044,072 filed in the United States Patent and Trademark Office on Apr. 11, 2008, the entire content of which is incorporated herein by reference.

BACKGROUND OF THE INVENTION (a) Field of the Invention

The present invention relates to a droplet discharge apparatus. More particularly, the present invention relates to a droplet discharge head and a droplet discharge apparatus that have a gas outlet.

(b) Description of the Related Art

Generally, a droplet discharge apparatus applies pressure to a liquid such that a droplet forms at a tip and subsequently drops therefrom. However, there is a problem that the size of the droplet cannot be reduced below a certain level when the droplet is forced to drop by applying pressure only.

In order to reduce the size of a droplet formed at the tip, the internal diameter of the tip must be reduced. However, the reduction of the internal diameter of the tip causes a problem that the tip is clogged with impurities accumulated therein. Further, even if the internal diameter of the tip is reduced, only reducing the size of the tip is limited in decreasing the size of the droplet since the surface tension of the droplet still remains.

Forces acting on a droplet just before the droplet drops from the tip are gravitational force, changes in the momentum of the droplet, and the surface tension of the droplet.

Here, if the combined value of the changes in the momentum and the gravitational force is greater than the surface tension, the droplet drops. Accordingly, however small the internal diameter of the tip is formed, it is difficult to reduce the size of the droplet below a certain level due to the surface tension.

In addition, it is extremely difficult to maintain a constant amount of the droplet that drops from the tip since the droplet falls instantaneously along with the amount of the change in momentum.

As new fields of application of nanometer-scale microstructures become more widely known, it is most important to provide tiny droplets for manufacturing nanometer-scale microstructures in an accurate manner. However, it is difficult to accurately provide droplets with a prior art.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a droplet discharge head and droplet discharge apparatus that are capable of providing an accurate amount of tiny droplets.

A droplet discharge head according to an exemplary embodiment of the present invention may include a nozzle for discharging a droplet from a tip thereof, and a discharge unit for injecting a gas in a direction toward the tip of the nozzle.

The discharge unit may include a housing having a discharge hole through which a gas is injected and a gas pipe for providing a gas to the discharge hole.

The tip of the nozzle may be inserted into the discharge hole. Further, the outer surface of the nozzle and the inner surface of the discharge hole may be spaced apart from each other by a predetermined distance. A gas may be injected through a space between the discharge hole and the nozzle.

The gas pipe may communicate with the housing.

The nozzle may include an upper nozzle and a lower nozzle that has a smaller inner diameter than that of the upper nozzle. The housing may include an upper hole into which the upper nozzle is inserted, and the lower nozzle may be inserted into the discharge hole. The outer surface of the lower nozzle and the inner surface of the discharge hole may be spaced apart from each other by a predetermined distance. A gas may be injected through a space between the lower nozzle and the discharge hole.

The housing may include an open portion that is open to the outside and a transparent plate that is disposed at the open portion, and the transparent plate may be made of a light-permeable material.

A plurality of discharge holes may be disposed at the housing, and a plurality of nozzles may be configured such that each of the nozzles is inserted into a discharge hole. The outer surface of each of the nozzles and the inner surface of each of the discharge holes may be spaced apart from each other by a predetermined distance.

A passageway may be formed in the housing and a gas is provided into the passageway, and the passageway may communicate with the discharge holes.

The discharge unit may be adjacent to the outer surface of the nozzle and may include injection pipes therein. Further, the discharge unit may surround the outer surface of the nozzle. There may be more than two injection pipes and they may be formed with the same distance therebetween.

A droplet discharge apparatus according to an exemplary embodiment of the present invention may include a nozzle for discharging a droplet from a tip thereof, a discharge unit for injecting a gas in a direction toward the tip of the nozzle, a liquid pipe connected to the nozzle and providing a liquid thereto, a liquid provider that contains a liquid therein and communicates with the liquid pipe, and a pump connected to the liquid provider and for controlling internal pressure of the liquid provider.

The discharge unit may include a housing having a discharge hole through which a gas is injected, and a gas pipe providing a gas to the discharge hole.

The discharge unit may be adjacent to the outer surface of the nozzle and may include an injection pipe therein.

The pump may operate such that a liquid is discharged through the liquid pipe from the liquid provider when the internal pressure of the liquid provider increases. The pump may be connected to a pump controller that controls the operation of the pump.

The liquid provider may include a chamber, a container that is disposed inside the chamber and contains a liquid, and a pressure detector that detects a difference between the pressure inside the chamber and the pressure of the liquid inside the container.

The pressure detector may provide information about the detected difference to the pump controller.

According to the present invention, a smaller droplet can be provided by injecting a gas toward a droplet formed at the tip of the nozzle.

In addition, the size of a droplet can be controlled in a more detailed way by forming a droplet at the tip of the nozzle and injecting a gas without a change in the momentum of the droplet.

In addition, a discharge hole is formed around the circumference of the nozzle such that it is easy to inject a gas toward the droplet and to provide the droplet to a desired location.

DESCRIPTION OF REFERENCE NUMERALS INDICATING PRIMARY ELEMENTS IN THE DRAWINGS

Figure 1:
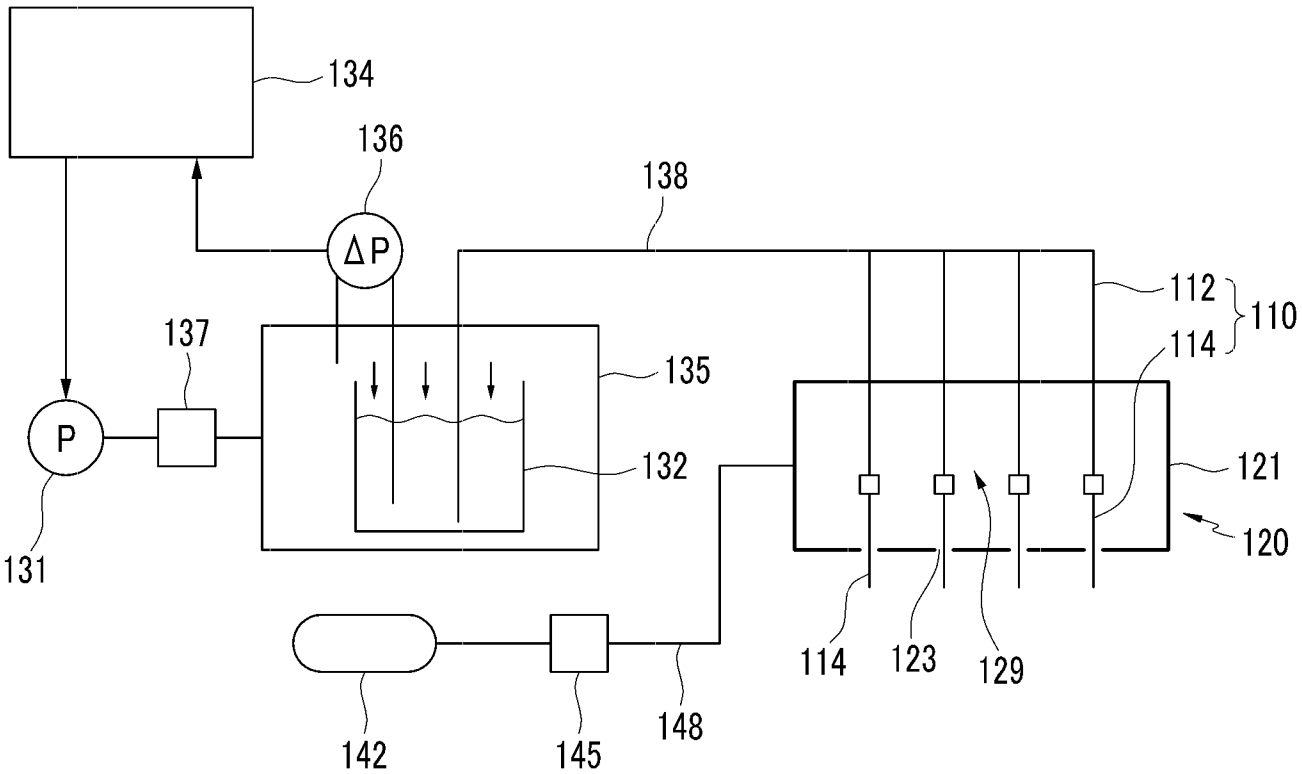
FIG. 1 is a schematic view of a droplet discharge apparatus according to a first exemplary embodiment of the present invention.

| | |
|---|---|
| 110, 410: nozzle | 112: upper nozzle |
| 114: lower nozzle | 116: droplet |
| 120: discharge head | 121: housing |
| 123: discharge hole | 124: transparent plate |
| 129: passageway | 131: pump |
| 132: container | 135: liquid provider |
| 136: pressure detector | 138: liquid pipe |
| 142: compressed-gas provider | 148: gas pipe |
| 148: gas pipe | |
| 420: discharge unit | 422: injection pipe |

DETAILED DESCRIPTION OF THE EMBODIMENTS

Hereinafter, the present invention will be described more fully with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

FIG. 1 is a schematic view of a droplet discharge apparatus according to a first exemplary embodiment of the present invention.

Referring to FIG. 1, a droplet discharge apparatus according to the first exemplary embodiment of the present invention includes a pump 131, a liquid provider 135, a compressed-gas provider 142, a liquid pipe 138, a gas pipe 148, and a droplet discharge head 120.

The pump 131 controls the internal pressure of the liquid provider 135 that contains a liquid. The liquid provider 135 includes a sealed chamber in which a container 132 that stores a liquid is arranged. In addition, the liquid pipe 133 is inserted into the container 138 such that one end of the liquid pipe 13 is immersed in the liquid.

When the internal pressure of the liquid provider 135 increases with the operation of the pump, the liquid can be discharged through the liquid pipe 138 to the outside of the liquid provider 135. A liquid pressure regulator 137 is installed between the pump 131 and the liquid provider 135. The liquid pressure regulator 137 transforms the pressure of air that is provided by the pump 131. A pump controller 134 is connected to the pump 131 and controls the operation of the pump 131.

A pressure detector 136 is installed in the liquid provider 135. The pressure detector 136 measures a pressure at the lower part of the container 132 and a pressure inside the chamber, and compares them. Further, the pressure detector 136 is connected to the pump controller 134 and provides information about the measured values to the pump controller 134. The pump controller 134 calculates the amount of the liquid in the container 132 using the information provided by the pressure detector 136. The pump controller 134 stops the operation of the pump 131 when the amount of the liquid is below a predetermined level.

The compressed-gas provider 142 includes a cylinder that contains compressed air. In addition, the compressed-gas provider 142 is connected to the gas pipe 148 via a gas pressure regulator 145.

The gas pressure regulator 145 controls the pressure of the gas flowing into the gas pipe 148.

Even though the present exemplary embodiment describes the air as an example of a gas, the present invention is not limited thereto and various kinds of gases can be used depending upon the kind of liquid to be used.

In addition, the compressed-gas provider 142 is not limited to a cylinder. Rather, any device or apparatus that is capable of providing a compressed gas to the gas pipe 148 can be used. For instance, the compressed-gas provider 142 can be a pump.

Figure 2:
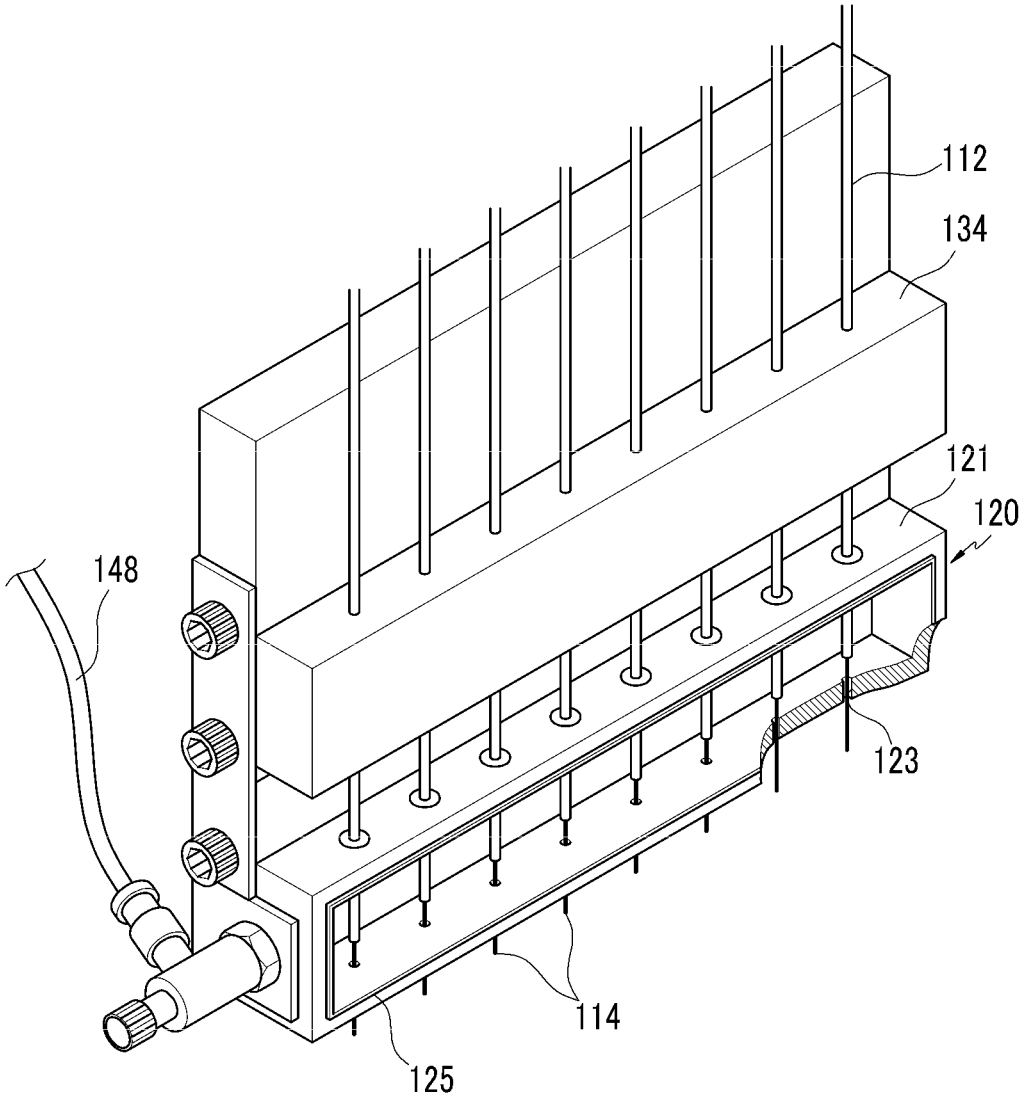
FIG. 2 is an exploded perspective view of a droplet discharge head according to the first exemplary embodiment of the present invention.
Figure 3:
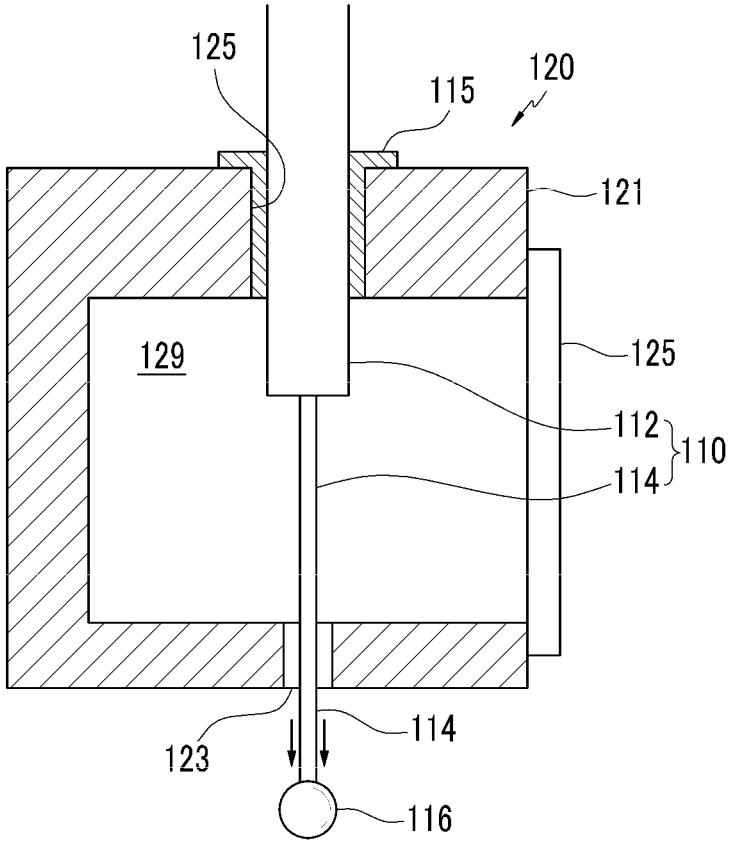
FIG. 3 is a partial cross-sectional view of a droplet discharge head according to the first exemplary embodiment of the present invention.

Hereinafter, referring to FIG. 2 and FIG. 3, a droplet discharge head according to the first exemplary embodiment of the present invention will be explained in detail.

The droplet discharge head 120 includes a housing 121, a nozzle 110 that is inserted into the housing 121, and a discharge hole 123 for injecting a gas toward the end of the nozzle 110.

The housing 121 is substantially hexahedral and includes a passageway 129 for circulating air. One face of the housing 121 is open to the outside and the open portion is sealed with a transparent plate 124. The transparent plate 124 is made of a light-permeable material. The transparent plate 124 provides information about the location of the nozzle to workers such that they can easily install the nozzle 110 into the housing 121.

The gas pipe 148 is connected to a wall of the housing 121, and a compressed gas is provided through the gas pipe 148 into the housing 121.

The nozzle 110 includes an upper nozzle 112, and a lower nozzle 114 that is disposed below the upper nozzle 112. The lower nozzle 114 is a pipe, and the inner diameter of the lower nozzle 114 is smaller than that of the upper nozzle 112 such that a tiny droplet can be easily discharged.

The upper nozzle 112 is connected to the liquid pipe 138. Consequently, a liquid provided by the liquid provider 135 flows through the liquid pipe 138 into the upper nozzle 112. An end of the upper nozzle 112 is inserted into the housing 121, and the upper nozzle 112 and the lower nozzle 114 are connected to each other. In addition, a liquid that flows into the upper nozzle 112 transfers to the lower nozzle 114. A portion that connects the upper nozzle 112 and the lower nozzle 114 is located inside the housing 121.

The housing 121 includes an upper hole 125 into which the upper nozzle 112 is inserted, and the discharge hole 123 into which the lower nozzle 114 is inserted. Consequently, the nozzle 110 penetrates the housing 121 vertically such that the end of the nozzle 110 protrudes downward from the housing 121.

A gasket 115 is arranged between the upper hole 125 and the upper nozzle 112 such that the space between the upper hole 125 and the upper nozzle 112 is sealed. Even though a gasket 115 is described as an example in the present exemplary embodiment, the present invention is not limited thereto, and a sealing member such as an O-ring can be used.

The discharge hole 123 is a hole with a constant inner diameter that is greater than the outer diameter of the lower nozzle 114. Further, the lower nozzle 114 is inserted into the discharge hole 123. Consequently, a space is formed between the discharge hole 123 and the lower nozzle 114 such that a gas is injected through the space. In addition, the space is constant between the discharge hole 123 and the lower nozzle 114 such that a uniform force can be applied to a droplet when a gas is injected.

If the space is not constant between the discharge hole 123 and the lower nozzle 114, a force may be applied unevenly when a gas is injected. In this case, if a droplet does not fall in a direction parallel to the direction of the gravitational force but falls obliquely, it is difficult to make the droplet fall to a desired location.

On the other hand, if the space is constant between the discharge hole 123 and the lower nozzle 114 as in the present exemplary embodiment, the droplet falls in a direction parallel to the direction of the gravitational force such that the droplet falls onto a desired location.

Even though the lower nozzle 114 is inserted into the discharge hole 123 in the present exemplary embodiment, the present invention is not limited thereto, and any structure can be used as long as the discharge hole 123 is close to the nozzle 110 such that a gas can be injected toward the end of the nozzle 110.

Therefore, more than one discharge hole 123 can be arranged.

A plurality of discharge nozzle 110 are disposed apart from each other in one direction inside the housing 121. The passageway 129 is formed along the same direction as a direction along which the nozzle 110 is disposed, and the passageway 129 communicates with the discharge hole 123. Therefore, a gas that flows into the housing 121 can be injected through the discharge hole 123.

When the liquid provider 135 provides a liquid to the nozzle 110, a droplet 116 is formed at the tip of the lower nozzle 114. Here, the droplet 116 does not fall since the surface tension of the droplet 116 is greater than the gravitational force upon the droplet 116.

In this case, if a compressed gas is injected through the discharge hole 123 toward the end of the lower nozzle 114, the droplet 116 falls due to the pressure of the gas.

Here, the gas easily reaches the droplet 116 because the gas is injected through the discharge hole 123. In addition, since a gas is injected in a direction parallel to the direction of the gravitational force, the droplet 116 falls along a direction parallel to the direction of the gravitational force such that the droplet 116 falls onto a desired location.

Figure 4:
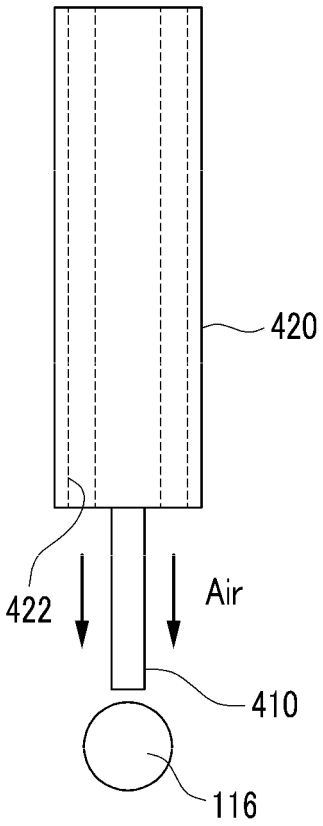
FIG. 4 is a longitudinal cross section of a droplet discharge head according to a second exemplary embodiment of the present invention.
Figure 5:
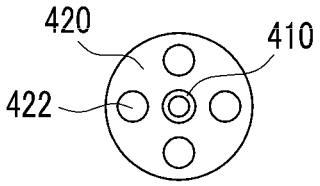
FIG. 5 is a transverse cross section of a droplet discharge head according to the second exemplary embodiment of the present invention.

FIG. 4 is a longitudinal cross section of a droplet discharge head according to a second exemplary embodiment of the present invention, and FIG. 5 is a transverse cross section of a droplet discharge head according to the second exemplary embodiment of the present invention.

Referring to FIG. 4 and FIG. 5, a droplet discharge head 400 according to a second exemplary embodiment of the present invention includes a nozzle 410 and a discharge unit 420.

The discharge unit 420 surrounds the outer surface of the nozzle 410 and includes injection pipes 422 therein.

The injection pipes 422 are passageways through which a gas is injected. The number of injection pipes 422 is four and the injection pipes 422 are spaced with the same distance therebetween. A gas injected from the injection pipes 422 moves in a direction toward the tip of the nozzle and easily arrives at the droplet 116. In addition, the direction and pressure of each gas that is injected toward the droplet 116 are the same because the injection pipes 422 are spaced with a same distance therebetween. Therefore, the droplet 116 is not slanted toward a certain direction while it is falling.

The injection pipes 422 may be located with a certain distance from the outer surface of the nozzle 410. Instead, the injection pipes 422 may be disposed adjacent to the outer surface of the nozzle 410.

Detailed description of the other elements and function thereof will be omitted since they are the same as those of the first exemplary embodiment of the present invention.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A droplet discharge head comprising:

a nozzle for discharging a droplet from a tip thereof; and a discharge unit for injecting a gas in a direction toward the tip of the nozzle, a housing within which the discharge unit is positioned, wherein the discharge unit is adjacent to and surrounds an outer surface of the nozzle, and wherein the discharge unit includes more than two injection pipes formed therein, the injection pipes (a) being spaced equidistant from each other, (b) extending in a direction substantially parallel to the nozzle, and (c) being arranged to surround the nozzle, wherein the nozzle includes an upper nozzle and a lower nozzle that has a smaller inner diameter than that of the upper nozzle, wherein the housing includes an upper hole into which the upper nozzle is inserted, and wherein the lower nozzle is inserted into the discharge unit.

2. The droplet discharge head of claim 1, further comprising:

a gas pipe for providing the gas to the discharge unit.

3. The droplet discharge head of claim 2, wherein the gas pipe communicates with the housing.

4. The droplet discharge head of claim 2, wherein the housing includes an open portion that is open to the outside and a transparent plate that is disposed at the open portion, and wherein the transparent plate is made of a light-permeable material.

5. The droplet discharge head of claim 2, wherein a plurality of discharge units are positioned within the housing, and a plurality of nozzles are configured such that each of the nozzles is inserted into a discharge unit.

6. The droplet discharge head of claim 5, wherein a passageway is formed in the housing and the gas is provided into the passageway.

7. The droplet discharge head of claim 6, wherein the passageway communicates with the injection pipes.

8. A droplet discharge apparatus comprising:

a nozzle for discharging a droplet of a liquid from a tip thereof;

a discharge unit for injecting a gas in a direction toward the tip of the nozzle;

a liquid pipe connected to the nozzle and providing the liquid thereto;

a liquid provider that contains the liquid therein and that communicates with the liquid pipe; and a pump connected to the liquid provider and for controlling internal pressure of the liquid provider, wherein the discharge unit is adjacent to and surrounds an outer surface of the nozzle, and wherein the discharge unit includes more than two injection pipes formed therein, the injection pipes (a) being spaced equidistant from each other, (b) extending in a direction substantially parallel to the nozzle, and (c) being arranged to surround the nozzle, wherein the liquid provider includes a chamber, a container that is disposed inside the chamber and contains the liquid, and a pressure detector that detects a difference between pressure inside the chamber and pressure of the liquid inside the container.

9. The droplet discharge apparatus of claim 8, further comprising: a housing within which the discharge unit is positioned; and a gas pipe for providing the gas to the discharge unit.

10. The droplet discharge apparatus of claim 8, wherein the pump operates such that the liquid is discharged through the liquid pipe from the liquid provider when the internal pressure of the liquid provider increases.

11. The droplet discharge apparatus of claim 10, wherein the pump is connected to a pump controller that controls operation of the pump.

12. The droplet discharge apparatus of claim 8, wherein the pressure detector provides information about the detected difference to the pump controller.

* * * * *